US011691069B2

(12) United States Patent
Gomez

(10) Patent No.: US 11,691,069 B2
(45) Date of Patent: Jul. 4, 2023

(54) HAND HELD CUE GUIDE WITH AN ADJUSTABLE HANDLE FOR PLAYING BILLIARDS GAMES

(71) Applicant: Eduardo Roberto Gomez, Plantation, FL (US)

(72) Inventor: Eduardo Roberto Gomez, Plantation, FL (US)

( * ) Notice: Subject to any disclaimer, the term of this patent is extended or adjusted under 35 U.S.C. 154(b) by 0 days.

(21) Appl. No.: 17/271,832

(22) PCT Filed: Aug. 28, 2018

(86) PCT No.: PCT/US2018/048299
§ 371 (c)(1),
(2) Date: Feb. 26, 2021

(87) PCT Pub. No.: WO2020/046279
PCT Pub. Date: Mar. 5, 2020

(65) Prior Publication Data
US 2021/0316205 A1 Oct. 14, 2021

(51) Int. Cl.
*A63D 15/10* (2006.01)

(52) U.S. Cl.
CPC ..... *A63D 15/105* (2013.01)

(58) Field of Classification Search
CPC ..... A63D 15/105
USPC ..... 473/42
See application file for complete search history.

(56) References Cited

U.S. PATENT DOCUMENTS 774,862 A * 11/1904 Blackburn ..... A63D 15/105 473/42
898,345 A * 9/1908 Farnham ..... A63D 15/105 473/42
3,411,779 A 11/1968 McGowan
3,711,091 A 1/1973 Dixon
4,053,153 A 10/1977 Josenhans
4,147,346 A 4/1979 Giannetti
4,151,990 A 5/1979 Josenhans
4,178,694 A 12/1979 Bonney et al.
(Continued)

FOREIGN PATENT DOCUMENTS

CN 2445779 5/2001
GB 2152390 A 2/1984
(Continued)

OTHER PUBLICATIONS

International Search Report and Written Opinion for PCT/US2018/048293 of the U.S. Patent and Trademark Office dated Dec. 20, 2018, 11 pp.
(Continued)

*Primary Examiner* — Mitra Aryanpour
(74) *Attorney, Agent, or Firm* — Edwin S. Flores; Chalker Flores, LLP

(57) ABSTRACT

The invention presents a hand held guide for cue shaft with an adjustable handle for playing billiard games. The guide comprises an elongated "V"-shaped guide containing said adjustable handle at least one axis that allow the pieces forming the axis to articulate up to 180 degrees. In addition, the handle contains at least one adjustable grip and the elongated "V"-shaped guide contains at least one concave groove to place the index finger or the middle finger when the person using the guide performs a closed bridge to wrap the guide.

28 Claims, 8 Drawing Sheets

(56) References Cited

U.S. PATENT DOCUMENTS

| | | | | |
|---|---|---|---|---|
| 4,268,033 | A | 5/1981 | Fontaine | |
| 4,461,043 | A | 7/1984 | Lomedico | |
| 4,877,242 | A | 10/1989 | James | |
| 5,003,637 | A | 4/1991 | Lonon | |
| 5,322,475 | A | 6/1994 | Irvin | |
| 5,597,360 | A | 1/1997 | Freedenberg | |
| 5,769,728 | A | 6/1998 | Kasino | |
| 5,853,333 | A * | 12/1998 | Patterson | A63D 15/105 473/42 |
| 5,954,589 | A | 9/1999 | Masters | |
| 6,042,481 | A * | 3/2000 | Walker | A63D 15/08 473/43 |
| 6,402,628 | B1 | 6/2002 | Neil | |
| 6,929,555 | B2 * | 8/2005 | Morton | A63D 15/105 473/42 |
| 7,303,483 | B2 | 12/2007 | Black | |
| 8,523,693 | B2 | 9/2013 | Nelson | |
| 8,870,669 | B1 * | 10/2014 | Griffin | A63D 15/105 473/42 |
| 9,539,492 | B1 * | 1/2017 | Eager | A63D 15/006 473/2 |
| 10,245,501 | B2 * | 4/2019 | Klimeck | A63D 15/105 473/42 |
| 2004/0031120 | A1 | 12/2004 | Cherian | |
| 2007/0079421 | A1 | 4/2007 | Davis | |
| 2007/0219008 | A1 | 9/2007 | Deakes | |
| 2008/0125233 | A1 | 5/2008 | Tucker | |
| 2009/0258718 | A1 | 10/2009 | Cyr | |
| 2010/0314427 | A1 | 12/2010 | Cartwright | |
| 2021/0316205 | A1 * | 10/2021 | Gomez | A63D 15/105 473/42 |
| 2022/0072411 | A1 * | 3/2022 | Bragg | A63D 15/105 473/42 |

FOREIGN PATENT DOCUMENTS

| | | | | |
|---|---|---|---|---|
| GB | 2196867 | A * | 5/1988 | A63D 15/105 |
| GB | 2196867 | A | 5/1988 | |
| GB | 2224945 | A1 | 5/1990 | |
| GB | 2348149 | A | 9/2000 | |
| GB | 2578130 | A | 4/2020 | |
| WO | 2020046279 | A1 | 3/2018 | |
| WO | 2020046277 | A1 | 3/2020 | |
| WO | 2020101647 | A1 | 5/2020 | |

OTHER PUBLICATIONS

International Search Report and Written Opinion for PCT/US2018/060638 of the U.S. Patent and Trademark Office dated Feb. 19, 2019, 12 pp.

Billiard Ball Sep. 11, 2018, https://en.wikipedia.org/wiki/Billiard_ball, accessed May 12, 2021, 8 pp.

International Search Report and Written Opinion for PCT/US2018/048299 of the U.S. Patent and Trademark Office dated Nov. 7, 2018, 15 pp.

* cited by examiner

HAND HELD CUE GUIDE WITH AN ADJUSTABLE HANDLE FOR PLAYING BILLIARDS GAMES

CROSS-REFERENCE TO RELATED APPLICATIONS

This application is the National Stage of International Application No. PCT/US2018/048299, filed on 28 Aug. 2018, the contents of each of which are incorporated by reference herein.

FIELD OF THE INVENTION

This invention relates to the apparatus for playing or performing games of sports and, more particularly to the game of billiards or pool. The invention presents a handheld guide for a cue shaft with an adjustable handle for playing billiard or pool.

BACKGROUND

The game of billiards and pool has been played for many years by a wide variety of people around the world. Pool and billiards are played professionally in many countries. According to the World Confederation of Billiard Sports (hereinafter "WCBS") the popularity of billiards has grown at unprecedented levels in recent times, making pool one of the world's most widely practiced sports. To put billiards in numbers, the WCBS hosts more than 200 competitions around the world, and the participants, just in the United States of America (hereinafter "U.S."), are around 34 million. General revenues from the sales of pool tables and equipment exceeds 2 billon dollars, all while employing more than 32,500 people just in the U.S. Popularity and professionalism of pool and billiard are such that many organizations including the World Professional Billiards and Snooker Association and the WCBS are asking the Olympic Committee to include pool and billiard as an sport for the 2024 Olympic Games.

Despite the sophistication and professionalism reached in pool and billiards, the game is widely played by amateurs and is becoming a fast growing activity among amateurs. The game is played by people who have billiard tables in their homes and, at the same time, is played in pool halls, taverns and recreational centers. Also, billiards games can be played by people of all ages.

Although the popularity of the game, is improving, learning the game has been a major task and continues to be a main obstacle to upgrade the performance of amateurs and to increase the popularity of the game. Books, videos, tutorials and devices—many of them expensive and complex—are examples of the different attempts to make the game easier to play and learn.

The present invention, however, will overcome the obstacles mentioned above, being at the same time a device that is affordable, user-friendly and can increase the performance of the players in a very short period of time, while also welcoming first and new players of pool who are frequently discouraged from playing a game that seems reserved only for professionals or very experienced players.

DESCRIPTION OF THE RELATED ART

With a few exceptions and variants, pool and billiard games (pool and billiards used interchangeably) are played mostly with a wood or similar material stick called a cue.

The cues have different shapes and are made with a wide range of materials. While more frequently cues are made of wood (e.g. Maple, Ash or Oak) other cue materials include aluminum, fiber glass and carbon fiber. It does not matter what materials are used to produce them, the structure or parts of a billiard cue include basically two parts: a) a butt end and b) a shaft. The butt includes different parts: i) a bumper at the end of the butt part; ii) a butt cap continues to the bumper; iii) a wrap or grip; and iv) a forearm. The shaft part includes: i) a tapered shaft projecting from the butt end part, ii) a ferrule at the other end of the cue and finally iii) a tip that impacts the cue ball. The purpose of the game consists of a billiard player hitting a specific ball (cue ball) making the cue ball roll and hit another ball, inserting the latest mentioned ball into one of the six pockets on a billiard table. In order to hit the cue ball, a billiard player basically grasps the butt end of the cue by the grip with one hand and holds the shaft with the other hand. The right way for a player to hold the cue shaft with his hand is called a bridge. A bridge is formed by placing a hand on the table and spreading the fingers apart such that the cue can smoothly slide between the fingers that hold the cue shaft. Finally, the billiard player executes a shot by moving the cue longitudinally relative to the bridge hand with a stroke.

One of the major problems of pool is to learn how to make a bridge, and more specifically how to make the right bridge for the right shot. There are many types of bridges and each of them serves its own purpose. One such invention is described in U.S. Pat. No. 3,416,794, that teaches that the bridge is probably the most difficult technique to learn and master. In order to achieve a great stroke the bridge hand needs to be well positioned and firmly on top of the table with the fingers spread open securing the cue shaft but allowing back and forth movements produced by the back hand. All these actions are difficult to achieve by beginners and amateur players.

Typically, the principal function of a bridge is to lock the cue shaft into a position to reduce or minimize unnecessary sideways movements. Bridges are classified between two principal categories, i) open bridges and ii) closed bridges. The open bridge is frequently used by amateurs and new players since it is easier to form when compared with a closed bridge. In addition, an open bridge is friendlier for newer players since the only requirement for the player is to do a "V" shape form with his/her hand using his/her thumb and his/her index finger allowing the cue stick to move over the angle formed by the "V"-shape. However, an open bridge is very useful when a player needs to make a soft or a follow shot. A closed bridge is used more among professional players. In a closed bridge the thumb, the index and the middle fingers wrap the cue shaft giving the player more control over the movement of the cue stick that allow the player to hit the cue ball with more control and power. How to form and maintain a bridge throughout the shot—whether open or closed—is not the single problem that players face. Another difficulty involving the bridge hand and the cue stick is that the surface and the shape of the player's hand is not the optimal sliding surface for moving the cue stick back and forth, and the problem worsens when the player's hand perspires and/or gets wet making the sliding surface sticky and thus, depriving the cue from the ideal smooth ride. These drawbacks discourage newer players from starting to play and enjoying the game. At the same time it delays the progress of beginners who desire to develop their abilities as quick as possible while keeping them motivated with the game.

Yet other difficulties that are faced by experienced players regarding the formation of a bridge can include: a) when players need to perform an elevated open bridge (e.g. to jump a ball or shoot over an object ball), they usually lose the control and stability of the cue since most of the surface of the fingers that form the bridge miss contact with the table; b) when players form a short closed bridge, they lose visibility on the shot since they lose sight of the shaft due to the index finger being wrapped around the shaft and, at the same time, not having an eye on the back hand (hand on the wrap/grip, this creates another difficulty when the player tries to control the stroke (shot)); c) yet another difficulty is when the players need to shoot the cue ball while the cue ball is making contact with the rail. These are considered among the most difficult strokes in pool and billiards games. Furthermore, in amateur games many discussions and even fights arise when a player—in order to avoid executing the shot from a difficult position—tries to move the cue ball with his/her hand to a different position or intends to separate the cue ball from the rail. Last but not least an important problem occurs when elderly people or people suffering arthritis or people with amputee fingers desire to perform a certain type of bridge.

The use of billiard and pool guides and related devices is known in the prior art. A few patents aim to solve the problem of the cue stick getting stuck or catch or being slow down by the fingers of the players that form the bridge. The purpose of these patents is to provide the pool cue stick with a smooth ride that is created by the use of the glove, glide or a related device. Among the patents included in this group are U.S. Pat. Nos. 4,025,962; 4,064,563; 4,103,362; 8,539,614 and U.S. Design Pat. No. 349,364. Another patent, U.S. Pat. No. 9,067,126 B2, which shows a cue hold guide comprising a glove and a cue channel securely attached to the "V" formed by the thumb and the base of the index finger. While this invention attempts to provide the glove with a rigid cue channel member to slide the cue stick towards it, the invention does not offer a realistic and practical training device for many reasons. One reason for that conclusion is given by the fact that the cue channel is positioned in a place that forces the player to adopt an improper position to play. This makes the player stiffen muscles and lock joints in an unnatural and uncomfortable way discouraging him/her from playing the game (e.g. for some shots the player would need to excessively flex his arm, shoulder or wrist so as to counter the position of the hand that carries the training device). Yet another reason is that the device described does not allow the player to have control on the strike because a) the device prevents the player from performing closed bridges that are necessary for performing specific shots and having more control over the stroke; and b) the cue channel length is around the same length that is created by putting together the thumb and the index finger, which short length does not prevent sideways movements of the cue stick. Thus, the described invention is not an efficient training tool to perform successfully opening break shots. To perform these shots with the described device, the player needs to focus his/her strength in a sudden and uncontrolled movement. Further, the described device has others drawbacks since: i) it does not prevent the cue stick from getting out the cue channel; ii) it cannot be used when the player needs to form a closed bridge and/or elevated bridge, or , in many situations when the player needs to form a bridge on the table's rail; iii) the concave shape of the cue channel does not prevent sideways movements thus causing miscues; iv) the rigidity of the cue channel may damage the shaft when the cue stick slides over it; v) the cue channel fixed to the glove makes the bridge hand of the player carry an obstructive member; and finally vi) after some time of use, the cue channel fixed to the glove can break the fabric of the glove due to the continuous force made by the shaft sliding over it.

Another alternative said to provide smoothness to the movement of the cue stick when it goes back and forth to strike the cue ball is introduced by U.S. Pat. No. 9,144,731 and commercial device "The Sleeve™". This device is installed on the cue shaft and provides the player an ergonomic grip to wrap the cue stick. While this device may solve the problem of the cue stick getting stuck or catch or being slow down by the fingers of the players that form the bridge, it actually increases—and not reduce as it is described in the patent—the friction of the cue stick. Then "The Sleeve™" is not capable of reducing any degree of friction of the cue stick. Another problem is that the friction produced by the contact between the device and the cue stick may damage and effectively darken the surface of the shaft of the cue after being used for a certain period of time. Another drawback of "The Sleeve™" is that it cannot be used with open bridges and elevated open bridges since the thumb and the index finger cannot wrap around the device properly. If "The Sleeve™" is just placed over the thumb or over the "V"-shape made by the index and the thumb fingers it cannot stand and/or grab on the hand, even when the "The Sleeve™" has embossed grip enhancing elements. Thus, any shot, besides a very soft stroke, required during the game would make sideways movements and/or the sleeve getting out of the bridge hand fully when using "The Sleeve™" with an open bridge. An additional sleeve is described in U.S. Pat. No. 5,478,282.

Other alternatives described in the prior art to eliminate or to aid the formation of the bridge so as to provide the players—especially the beginners—with stability in their strokes are represented by a wide diversity of guides or rails. U.S. Pat. App. Publication No. 2011/0070959A1 provides a clip/fastener with a wheel to attach it to the cue shaft, commercially known as "Junior Shark Guiding Wheel". This device is meant to be used with one hand only and it has a lot of restrictions. U.S. Pat. No. 4,053,153 describes a bridge training device including a rigid base and an elongated guide attached to it by a support post of a certain height. U.S. Pat. No. 7,611,416 describes a fix tubular adapter to place the cue stick inside. U.S. Pat. No. 3,416,794 describes a bridge aid-device formed by a ring-shaped member joined to a channel on top of the ring. Another aid-guide device proposed for a pool or billiard cue is given by U.S. Pat. No. 3,851,876 and provides the user with a rectangular elongate device with a concave cue guide notch that helps the user place the cue stick over it while he/she hits the cue ball.

On the other hand, a group of patents is delimited by U.S. Pat. Nos. 9,539,492; 4,147,346, 3,416,794 and 5,238,457, which provide different devices that let the player strike the cue ball without making a bridge or making a bridge while being assisted by the device. U.S. Pat. No. 9,539,492 describes a guide rail mounted over a support which can be positioned on either a table or tripod to hit the cue ball from an elevated position. U.S. Pat. No. 4,147,346 provides a guide adapted to be hand held and receive the cue shaft when playing pool. Finally, U.S. Pat. No. 5,238,457 comprises a sliding cue holder device having an upright post with a half circular cylindrical drum member fixed to the bottom of the post and a horizon sleeve fixed to the upper portion if the post.

While these patents attempt to provide the user with more stability in their stroke, eliminating almost the formation of the bridge, they all introduce an obstructive member making the billiard and/or pool game more complex and difficult to play. U.S. Pat. No. 4,147,346, provides a bulky device that disturbs the player while playing the game. Some problems that this device introduces are as follows: (i) the device is bulky and too large for the player's hand to perform a closed bridge; according the patent document, a closed bridge is required to put together the two equal pieces that form the sleeve; (ii) if the player has a small hand (e.g. generally women and children) he/she will not be able to use the device properly having miscues; (iii) the bulky size of the sleeve removes the vision of the player from the cue shaft making the player lose control over the stroke; (iv) although the tubular handle of the device can be detachable making the player use the device alone, the bulky size of the sleeve deprives the player from the right shot when he/she plays over different rails and/or over the table (e.g. the bulky size of the sleeve cannot be as close as it would require to make some shots); (v) the device increases, not reduces, the friction between the cue stick and the sleeve since the sleeve has a plurality of spherical members in form of ball bearing inside; (vi) another drawback of the invention is that the tubular sleeve structure is securely fixed to the hand not allowing movements of the sleeve to different strokes; and finally (vii) the semi-frusto-conical shape of the cue stick cannot prevent circular movements of the cue stick since the wider portion of it, the one that is closer to the butt end, does not wrap around the cue shaft properly allowing it to perform circular movements when strike.

U.S. Pat. No. 5,238,457 provides another example of a cue slider device having an upright post with a half circular cylindrical drum on the bottom of the post and a horizontal sleeve fixed across the upper portion of the post. Again, the same problems mentioned in the previous paragraph apply to this invention. In addition, the half circular cylindrical drum on the bottom of the post makes the device more uncomfortable (e.g. when a player desires to perform a shot over the rail close to a pocket).

Most recently, U.S. Pat. No. 9,539,492 provides a cue guide device mounted over a support that can be used directly over the pool table or mounted over a tripod. The support allows movements thank to a complex plurality of V-wheels. Nevertheless, the cue device proposed is bulky, uncomfortable and/or impossible for the player to use when he/she plays close to the rails, since the size of the support does not leave the room to the player to place the support on the table. Furthermore, the tripod base introduces an uncomfortable and strange element to the pool game.

Consequently, the inventions described in the prior art do not provide the player with a useful solution to improve their pool or billiard performance.

SUMMARY OF THE INVENTION

It is an objective of the present invention to provide a simple, useful, user-friendly and affordable hand held cue guide with an adjustable handle to improve the efficiency and performance of pool and/or billiard players.

According to the foregoing objective, the present invention provides a pool or billiard hand held cue guide with an articulated handle to perform different shots allowing the player to use the device easily while playing the game. The benefits of the invention are that it presents a device which is simple, small, handled and adaptable to the hand of every player. Technically, the invention provides two major benefits over the prior art. The first benefit is that the elongated "V"-shape of the cue guide is easy to carry and handle. The second benefit of the device is that the handle is easily articulated and/or adjustable.

The "V"-shape of the cue guide provides a higher stability when placing the cue shaft on the guide, preventing lateral and/or sideway movements of the cue shaft, improving over the prior art, including the following: U.S. Pat. No. 3,416,794 that provides a concave and short slider; U.S. Pat. No. 4,147,346 that provides a semi-frusto-conical shape cue glide guide; and U.S. Pat. No. 5,238,457 that provides a concave conical tube. In a preferred embodiment, the "V"-shaped cue guide is an elongated guide that enables the player not only to place the cue shaft into a fixed point, but also to avoid or aid the player to form a bridge. In addition, the player can perform a closed and an elevated bridge since the device, in comparison to U.S. Pat. Nos. 4,147,346 and 5,238,457, is small and easy to wrap. Moreover, the cue guide herein presented has at least one concave groove to place the index finger over one side of "V"-shaped side of the guide. In a preferred embodiment, the "V"-shaped cue guide has two concave grooves to place either the index and/or the middle finger while performing a closed bridge. The two-concave designs allow the player to graduate the shooting angle depending on what concave groove the player chooses to place his/her index finger. Thus, by positioning the thumb finger below the cue guide and choosing the concave groove closest to the edge of the cue guide, the player increases the angle of the cue guide. On the other hand, by positioning the thumb finger below the cue guide and choosing the concave groove closest to the middle of the cue guide, the player decreases the angle of the cue guide. To that end, the thumb finger serves as a supporting point to balance or rotate the cue guide.

Another feature of the cue guide is that its length enables the player to move the cue shaft back and forth a sufficient distance to stroke with more stability since the force of the shot does not come from a sudden movement but from a guided stroke along the length of the cue guide. This allows the player to perform break or open strokes as it is shown in FIG. 7. The elongated guide length ranges from 5 to 15 inches. In a preferred embodiment, the total length of the guide ranges from 7 to 12 inches. In a most preferred embodiment, the length of the "V"-shaped guide is 9 inches. In an alternative embodiment, the cue guide comprises a "V"-shape with a flat bottom that permits the cue guide to be placed on the table eliminating sideways movements.

Another benefit of the device is that the cue guide has an adjustable handle easy to use and easy to place over the pool table or over the rails of the table. The adjustable handle is made of two pieces, an inferior and a superior piece. The inferior piece is joined with the superior piece by an adjustable screw that fits to a nut. The top of the inferior piece has a half crest that matches another haft crest that the superior piece has at its button portion. Both half crests have a circular hole through which a screw crosses until it fits into the nut already mentioned. In a preferred embodiment, the screw's head is hand adjustable. In a preferred embodiment, the nut is recessed on the superior piece. On the other hand, the superior piece has three crests on its top portion that match with two other crests that belong to the "V"-shaped cue guide. The two crests of the "V"-shaped guide are perpendicular to a side of the "V"-shaped cue guide. Accordingly, each of the five crests belonging to the superior piece and the V-shaped cue guide has a circular hole though which a screw crosses until it fits into the nut joining together both members. The nut of the superior piece is recessed on the superior piece. In a preferred embodiment, the screw's head is hand adjustable. Both joints of the handle allow a rotation of at least 180 degrees permitting the player to perform the right strokes. Thus, by adjusting the handle, the player can perform many strokes over the rails or close to the pockets. In addition, the device allows the player to use the cue guide in a flat position on the pool table as it is later shown in FIG. 6. Further, when the player needs to perform a stroke over the rails he/she does not need to use an external apparatus such as the tripod mentioned in U.S. Pat. No. 9,539,492. The player only needs to articulate the handle in a position that allows the player to perform a comfortable stroke. When playing in the middle of the table, the player can perform a regular bridge (open or closed) by wrapping the cue guide to put the handle in a flat position or just wrapping the cue guide with his/her fist placing it on the table while the handle remains in a flat position as it is shown in FIG. 6.

Yet another advantage of this cue guide is provided by the fact that the device allows the player to strike the cue ball when there is another ball near the cue ball or what is called in the practice "shooting over the ball" as is it shown in FIG. 3. To proceed to perform this shot, the player just needs to articulate the handle in an "L" shape placing his/her bridge hand parallel to the cue ball while having the cue guide end over the ball to be shot over. This allows the player to not only perform the stroke properly, but also to have full visibility over the entire shot since the handle does not interfere with his/her view. In a preferred embodiment, the cue guide is made of transparent polycarbonate. In a preferred embodiment the upper surface of the cue guide is covered with a smooth and soft material so as to reduce the friction of the cue shaft when it slides over it.

In an alternative embodiment, the handle of the cue guide contains just one axis as it is shown in FIG. 8. In this embodiment, the handle is made of one piece. Said piece has three crests on its top portion that match with two other crests that belong to the "V"-shaped cue guide. The two crests of the "V"-shaped guide are perpendicular to a side of the "V"-shaped cue guide. Accordingly, each of the five crests belonging to the piece of the handle and the V-shaped cue guide has a circular hole through which the screw crosses until it and fits into the nut joining together both members. The nut of the piece of the handle is recessed on the piece. In a preferred embodiment, the screw's head is hand adjustable. Both joints of the handle allow a rotation of at least 180 degrees permitting the player perform the right strokes.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DETAILED DESCRIPTION AND PREFERRED EMBODIMENTS

Figure 1:
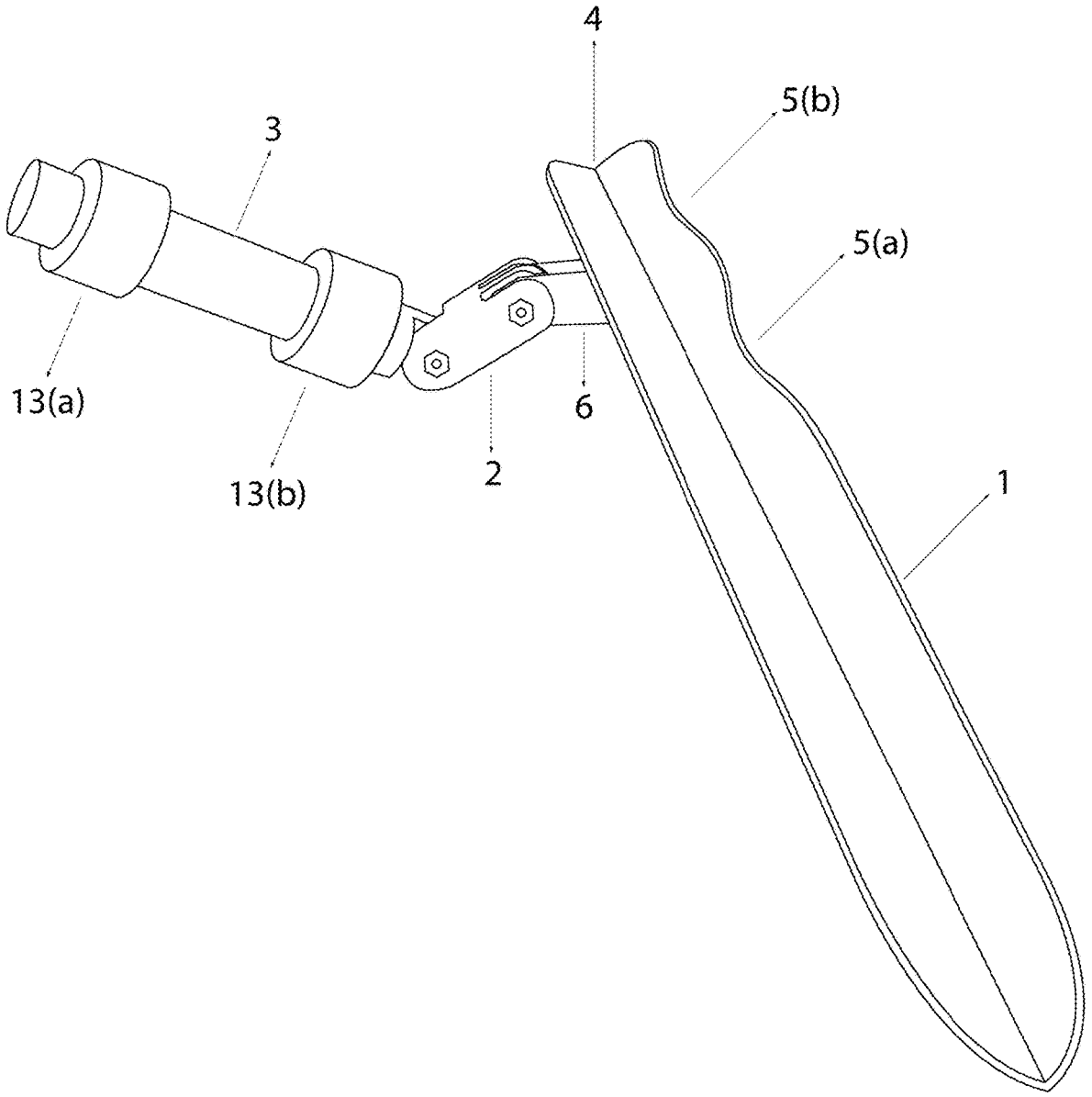
FIG. 1 is an exploded view of the embodiment of the hand held cue guide with an adjustable handle according to the present invention.

Referring now to the drawings and particularly to FIG. 1, the cue guide is shown 1 with two concave grooves 5(*a*) and 5(*b*) to place the index and/or the middle finger, for example, when the player is performing a closed bride. In addition, FIG. 1 shows the articulate handle with its inferior piece 3 having two movable grips 13(*a*) and 13(*b*) connected to the superior piece 2 and the two crests 6 belonging to the "V"-shaped cue guide 4 of the cue guide 1.

Figure 2:
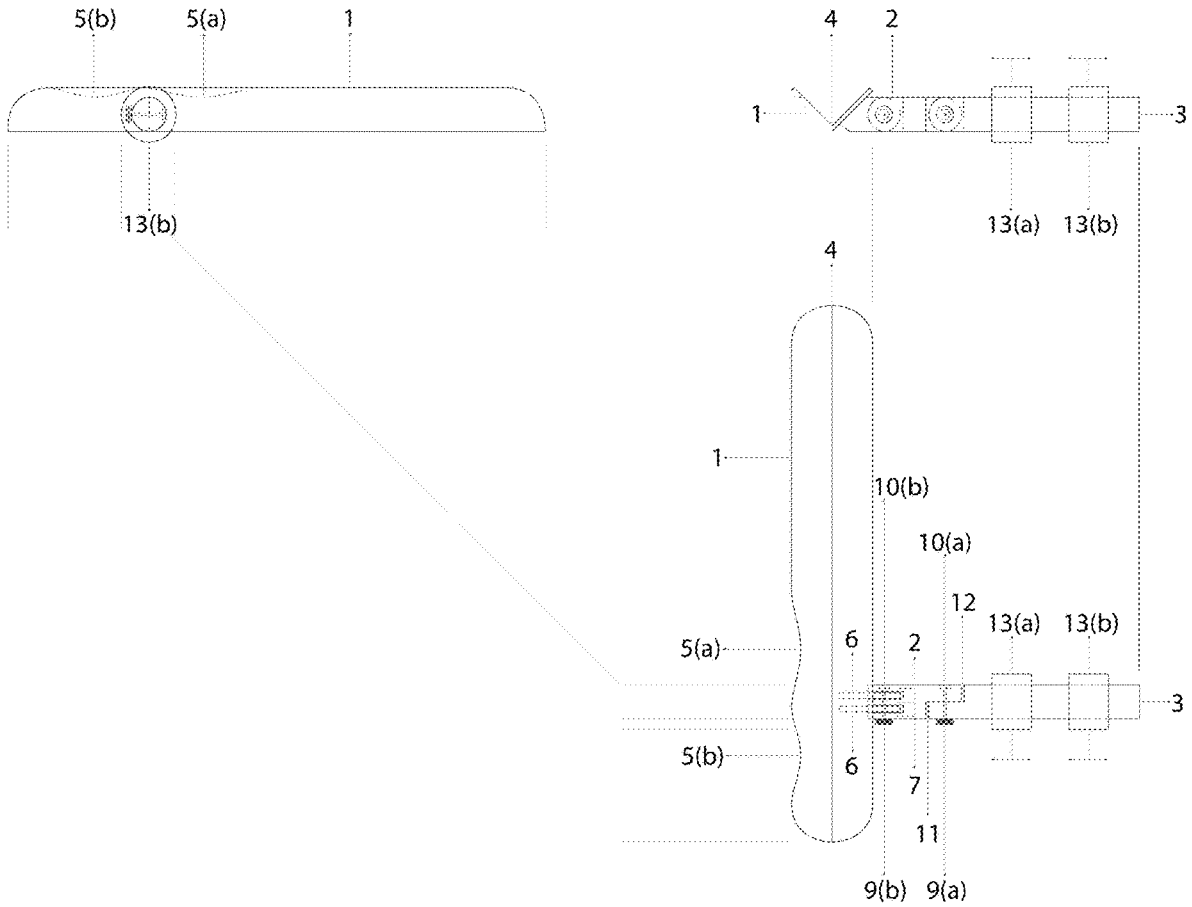
FIG. 2 is a representative view of the embodiment showing the invention from three different perspectives.

FIG. 2 shows a flat view of the cue guide 1 with its adjustable handle formed by its two pieces 2 and 3. FIG. 2 shows the joint between the inferior 3 and the superior 2 piece by both haft crests 12 and 11 respectively, connected by a screw 9(*a*) and a recessed nut 10(*a*) placed on the superior piece 2. In addition, FIG. 2 shows the joint between the superior piece 2 and the cue guide 1 produced by the match of the three crests 7 of the superior piece 2 of the handle with the two crests 6 that extend from the "V"-shaped cue guide 4 of piece 1. The five crests in the joint are secured by a screw 9(*b*) that crosses though the holes in the five crests until reaching the recessed nut 10(*b*). FIG. 2 also shows grips 13(*a*) and 13(*b*) and concave grooves 5(*a*) and 5(*b*).

Figure 3:
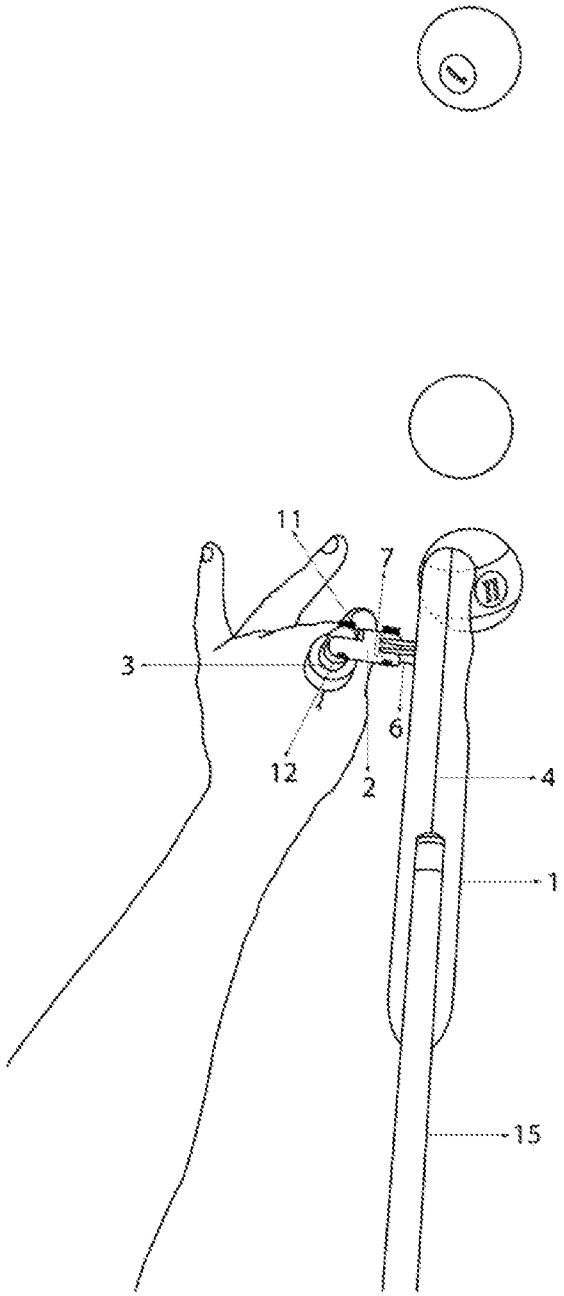
FIG. 3 is a representative view of the embodiment of the invention forming an "L" shape with the handle to perform an over ball shot. The articulated handle of the cue guide contains two axes.

FIG. 3 shows a player performing an over ball shot. To perform this stroke, the player articulates the inferior 3 and superior 2 pieces so as the make a 90 degree angle forming an "L" shape. The cue shaft 15 slides over the "V"-shaped 4 of cue guide 1. The joint among the three crests 7 of the superior portion 2 of the handle and the two crests 6 of the cue guide piece 1, as well as the joint between the inferior piece 3 and the superior piece 2 with their the half crests members 12 and 11, are shown in FIG. 3. Finally, this figure shows how the player has full visibility over the entire shot since in a preferred embodiment the guide is transparent, and the hand holding the articulated handle does not interfere with his/her view.

Figure 4:
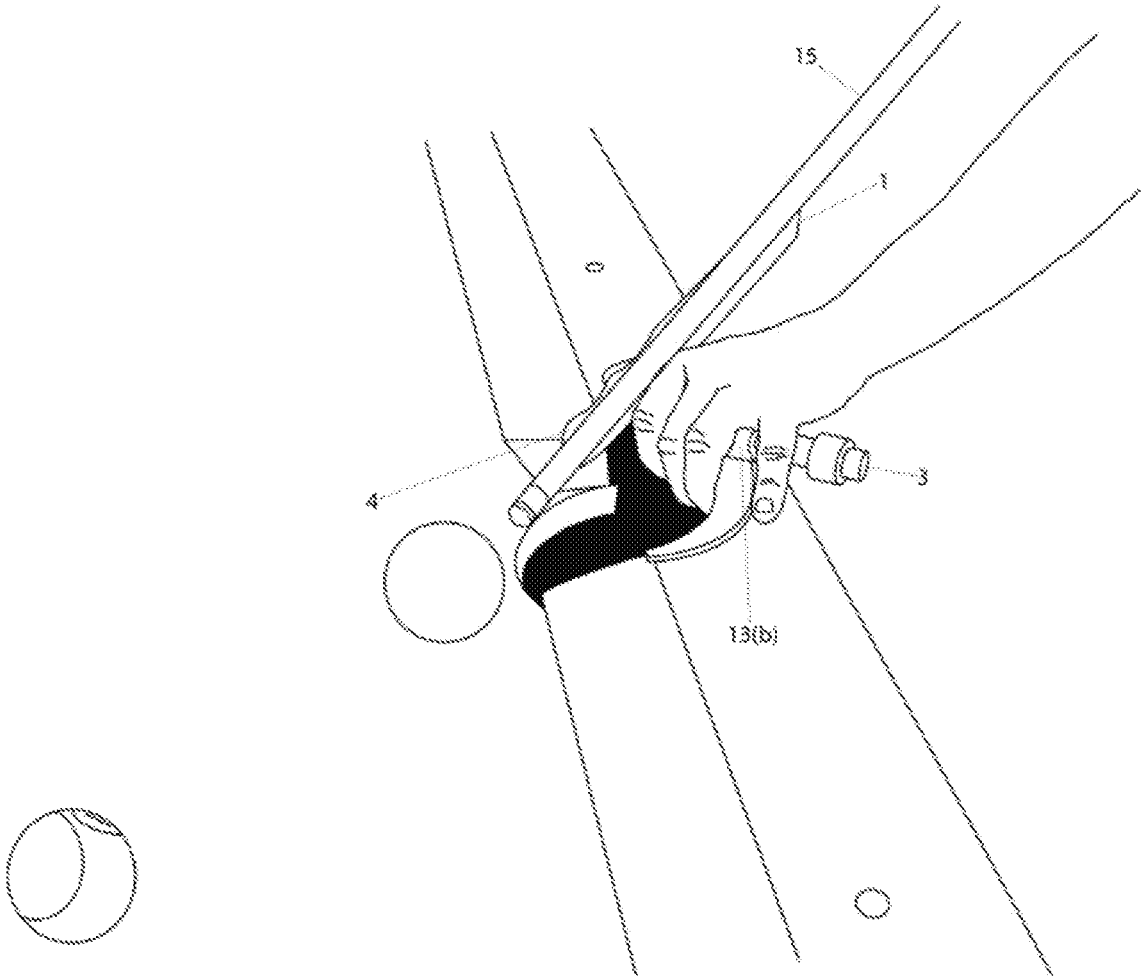
FIG. 4 is a representative view of the hand held cue guide with an adjustable handle when the player performs a shot over the pocket of the table.

FIG. 4 shows a player shooting close to the pocket and placing the handle made of pieces 3 and 2 and the cue guide 1 almost in a flat position allowing his/her fingers to hold the handle with the borders of the pocket. The figure shows how the player moves the cue shaft 15 along the entire surface of the "V"-shaped guide 4 of piece 1. In FIG. 4, the player is adjusting the grip 13(*b*) to make soft contact to the borders of the superior part of the pocket.

Figure 5:
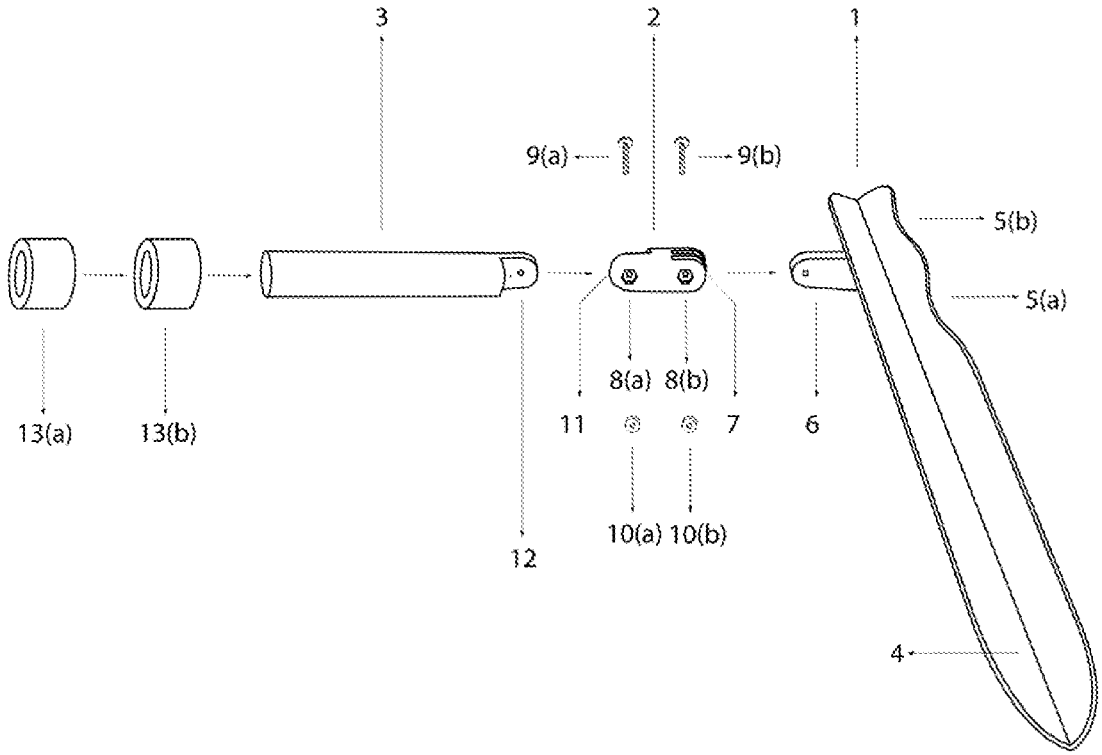
FIG. 5 is a dismembered view of the invention.

FIG. 5 shows a fully and dismembered view of the device presented in the invention, where it can be seen that the two grips 13(*a*) and 13(*b*) fit into the inferior piece 3. The inferior piece 3 has at one end a half crest 12 that matches with another half crest 11 belonging to superior piece 2. The superior piece 2 contains a pair of screws 9(*a*) and 9(*b*) and a pair of nuts 10(*a*) and 10(*b*) recessed countersink, countersunk and/or counterbored holes on the exterior side 8(*a*)

and 8(*b*) of superior piece 2. In addition, piece 2 contains at the upper edge three crests 7 that match two other crests 6 that extend from cue guide 1. The cue guide represented as 1 has a "V"-shape 4 containing two concave grooves 5(*a*) and 5(*b*) for placing the index and/or the middle finger.

Figure 6:
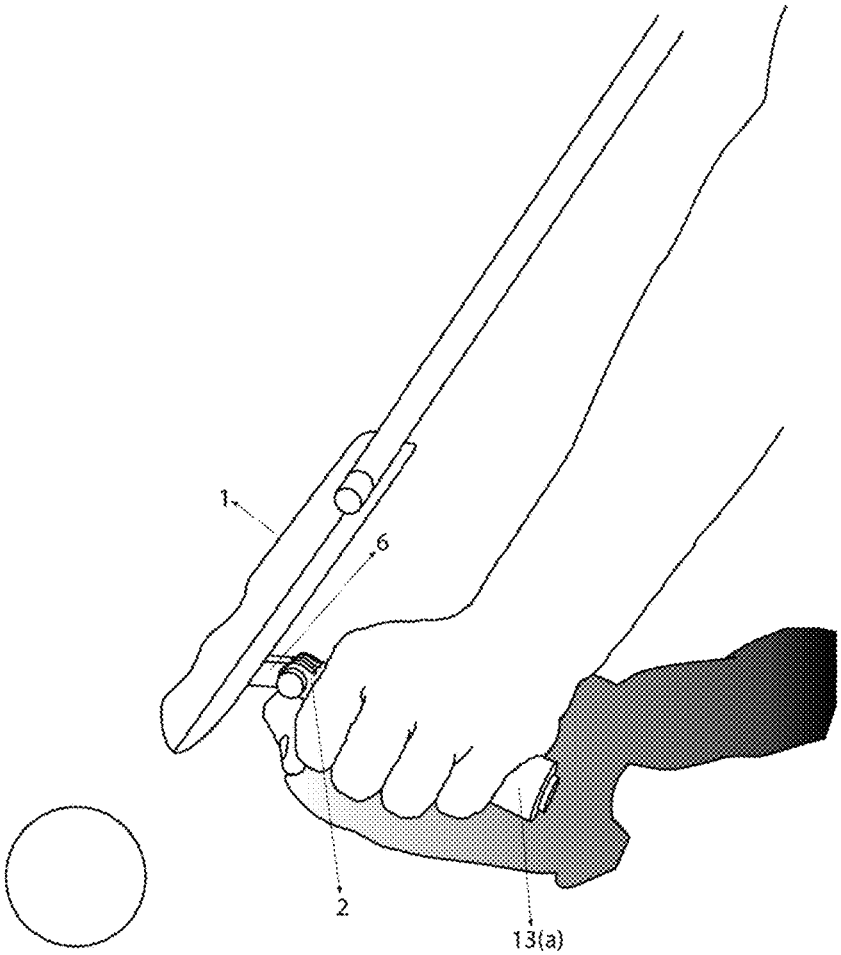
FIG. 6 is a representative view of the hand held guide for cue shaft when used on a regular play flat on the table without performing a bridge.
Figure 6:
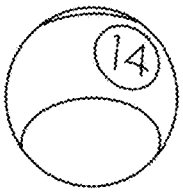

FIG. 6 shows the player performing a shot placing his/her hand on the table without forming a bridge to hold the handle. The joint of the superior part 2 and the two crests 6 shows a comfortable articulation of the handle to perform the shot. FIG. 6 shows that the player just wraps the handle of the cue guide 1 with his fist without performing a bridge. The grip 13(*a*) is making soft contact with the table.

Figure 7:
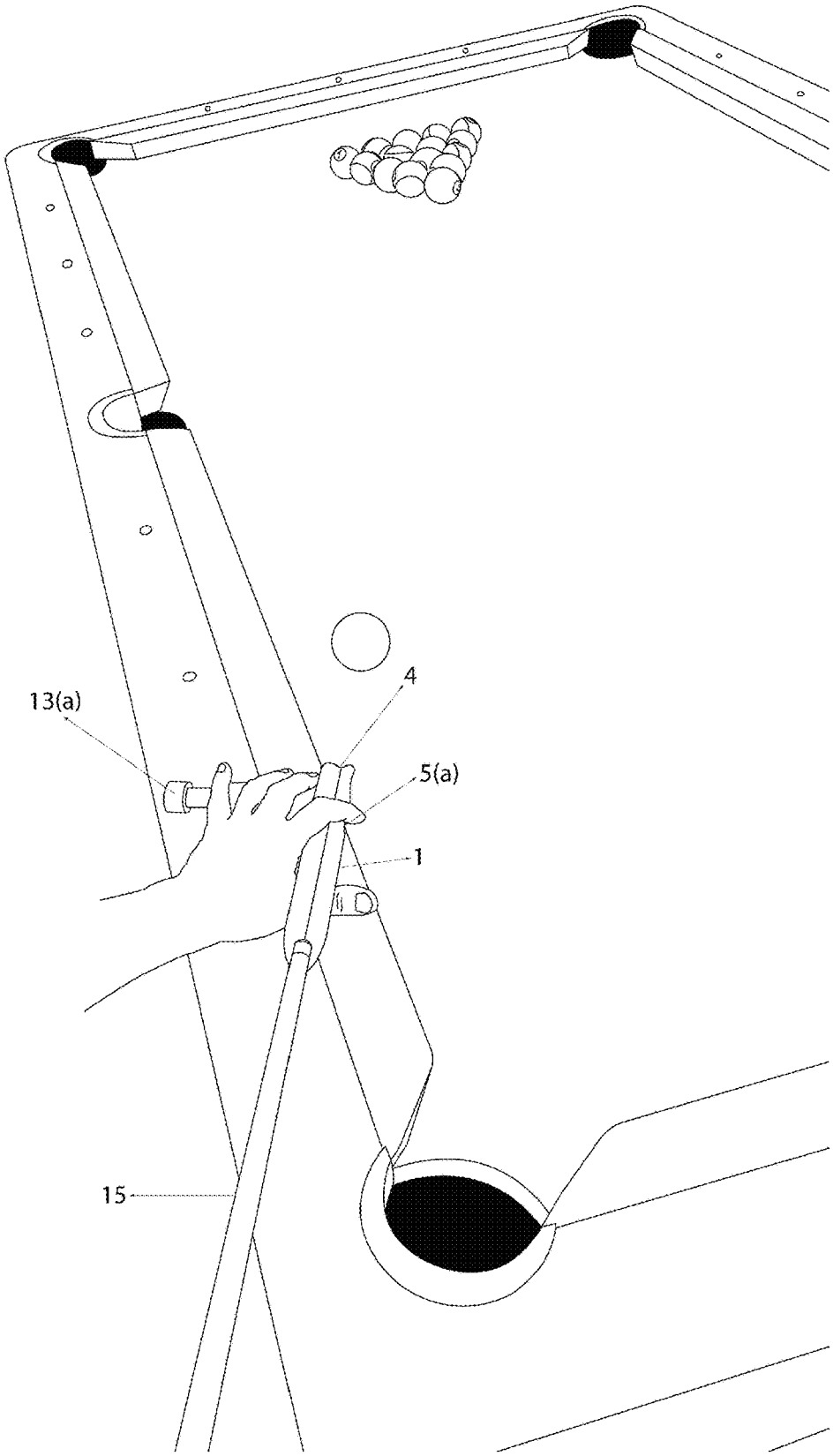
FIG. 7 is a representative view of the player while using the hand held cue guide in a flat position when it is placed on the rail performing a break or opening shot.

FIG. 7 shows a representative view of the player using the hand held cue guide 1 when playing on the rail and performing a break or opening shot. For the mentioned shot, the player uses the hand held cue guide 1 in a flat position. The figure shows the player moving the cue stick back as much as possible 15 over the "V"-shape 4 of the cue guide 1 to perform the break shot. FIG. 7 shows how the player places the articulated handle in a flat position moving the grip 13(*a*) towards the end of the handle, while placing the index finger on the concave groove 5(*a*). The action of moving the cue stick as far as the guide allows it generates more control power on the shot by distance and not by a sudden move, as if the player would not be using the hand held cue guide 1.

Figure 8:
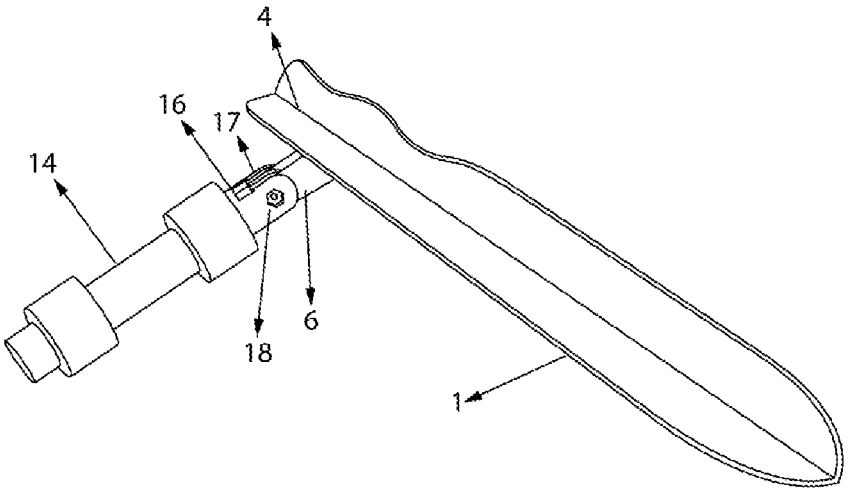
FIG. 8 is a representative view of the hand held cue guide containing a sole articulated axis.

FIG. 8 is a representative view of the hand held cue guide 1 containing a sole articulated axis. In addition, FIG. 8 shows the joint between the handle piece 14 and the cue guide 1. The joint between the mentioned portions occurred by the match of the three crests 16 of the piece 14 of the handle with the two crests 6 that extend from the "V"-shape 4 of the cue guide 1. The five crests in the joint are secured by a screw 17 that crosses through the holes of the five crests until it reaches the nut 18.

Although this invention has been described in detail with particular reference to the preferred embodiments, other embodiments can achieve almost the same results. Variations and modifications of the present invention will be considered obvious to those skilled in the art and it is intended to cover in the appended claims all such modifications and equivalents.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), property(ies), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skill in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

To aid the Patent Office, and any readers of any patent issued on this application in interpreting the claims appended hereto, applicants wish to note that they do not intend any of the appended claims to invoke paragraph 6 of 35 U.S.C. § 112 as it exists on the date of filing hereof unless the words "means for" or "step for" are explicitly used in the particular claim.

For each of the claims, each dependent claim can depend both from the independent claim and from each of the prior dependent claims for each and every claim so long as the prior claim provides a proper antecedent basis for a claim term or element.

What is claimed is:

1. A hand held guide for a cue shaft used to strike a cue ball comprising:

a cue guide with an adjustable handle for playing billiard games, wherein the cue guide is an elongated "V"-shaped guide and the adjustable handle is made of an inferior piece and a superior piece that are joined by a match of crests that extend between the inferior piece and the superior piece, wherein the crests are secured by an adjustable screw, and wherein the superior piece is joined to the cue guide by the match of crests extended from the superior piece to the cue guide, and wherein the crests are secured by a screw;

wherein said adjustable handle has at least one axis that allows the adjustable handle to articulate up to 180 degrees separately from the "V"-shaped guide of the cue guide.

2. The hand held guide for cue shaft as set forth in claim 1, wherein said adjustable handle has two axes that allows the handle to articulate up to 180 degrees.

3. The hand held guide for a cue shaft as set forth in claim 1, wherein the exterior end of one side of said hand held guide has at least one groove to place the index and/or the middle finger when the person uses the guide.

4. The hand held guide for a cue shaft as set forth in claim 1, wherein the exterior end of one side of said hand held guide has two grooves to place the index and/or the middle finger when the person uses the guide.

5. The hand held guide for a cue shaft as set forth in claim 1, wherein the elongated length of the guide ranges from 5 to 15 inches.

6. The hand held guide for a cue shaft as set forth in claim 1, wherein the elongated length of the guide ranges from 7 to 12 inches.

7. The hand held guide for a cue shaft as set forth in claim 1, wherein the elongated length of guide is 9 inches.

8. The hand held guide for a cue shaft as set forth in claim 1, wherein said guide is made of a material selected from a group of: plastic, polycarbonate, wood, glass or a combination thereof.

9. The hand held guide for a cue shaft as set for in claim 1, wherein said guide is made of transparent polycarbonate.

10. The hand held guide for a cue shaft as set for in claim 1, wherein said handle has at least one movable grip.

11. The hand held guide for a cue shaft as set for in claim 1, wherein said handle has two movable grips.

12. The hand held guide for a cue shaft as set for in claim 11, wherein each grip is made of a material selected from a group of: rubber, silicone or a combination of thereof.

13. The hand held guide for a cue shaft as set for in claim 1, wherein the said "V"-shaped guide contains a flat bottom.

14. The hand held guide for cue shaft as set forth in claim 1, wherein said adjustable handle attaches substantially perpendicular to the "V"-shaped guide.

15. The hand held guide for cue shaft as set forth in claim 14, wherein said adjustable handle has two axes that allows the handle to articulate up to 180 degrees.

16. The hand held guide for cue shaft as set forth in claim 14, wherein the exterior end of one side of said hand held guide has at least one groove to place the index and/or the middle finger when the person uses the guide.

17. The hand held guide for cue shaft as set forth in claim 14, wherein the exterior end of one side of said hand held guide has two grooves to place the index and/or the middle finger when the person uses the guide.

18. The hand held guide for cue shaft as set forth in claim 14, wherein the elongated length of the guide ranges from about 5 to 15 inches, about 7 to 12 inches, or about 9 inches.

19. The hand held guide for cue shaft as set forth in claim 14, wherein said guide is made of a material selected from a group of: plastic, polycarbonate, wood, glass or a combination thereof.

20. The hand held guide for cue shaft as set forth in claim 14, wherein said guide is made of transparent polycarbonate.

21. The hand held guide for cue shaft as set forth in claim 14, wherein said handle has at least one movable grip.

22. The hand held guide for cue shaft as set forth in claim 14, wherein said handle has two movable grips.

23. The hand held guide for a cue shaft as set for in claim 21, wherein each grip is made of a material selected from a group of: rubber, silicone or a combination of thereof.

24. The hand held guide for a cue shaft as set for in claim 22, wherein each grip is made of a material selected from a group of: rubber, silicone or a combination of thereof.

25. The hand held guide for a cue shaft as set for in claim 14, wherein the said "V"-shaped guide has a flat bottom.

26. The hand held guide for a cue shaft as set for in claim 23, wherein the said "V"-shaped guide has a flat bottom.

27. The hand held guide for a cue shaft as set for in claim 24, wherein the said "V"-shaped guide has a flat bottom.

28. A hand held guide for a cue shaft used to strike a cue ball comprising:

a cue guide with an adjustable handle for playing billiard games, wherein the cue guide is an elongated "V"-shaped guide, wherein the cue guide and the adjustable handle are joined by a match of crests that extend between the adjustable handle and the elongated "V"-shaped guide, wherein the crests are secured by an adjustable screw;

wherein said adjustable handle has at least one axis that allows the "V"-shaped guide of the cue guide to articulate about the adjustable handle up to 180 degrees.

* * * * *